United States Patent [19]

Rooney

[11] Patent Number: 4,500,757

[45] Date of Patent: Feb. 19, 1985

[54] MOMENTARY DIGITAL ENCODING DEVICE FOR KEYBOARDS

[75] Inventor: Craig E. Rooney, Prairie Village, Kans.

[73] Assignee: Engineering Research Applications, Inc., Prairie Village, Kans.

[21] Appl. No.: 396,039

[22] Filed: Jul. 7, 1982

[51] Int. Cl.[3] ..... H01H 13/70; G08C 9/00

[52] U.S. Cl. ..... 200/5 A; 200/159 B; 200/264; 340/365 R; 340/365 A

[58] Field of Search ..... 200/1 R, 5 R, 5 A, 5 E, 200/86 R, 159 B, 264; 340/365 R, 365 S, 365 E, 365 A; 235/145 R; 84/DIG. 7

[56] References Cited

U.S. PATENT DOCUMENTS

| | | | |
|---|---|---|---|
| 3,592,979 | 7/1971 | Redman | 200/1 R |
| 3,696,408 | 10/1972 | Bouchard et al. | 200/264 X |
| 3,723,673 | 3/1973 | Clary et al. | 200/1 R |
| 3,725,908 | 4/1973 | Brisebarre et al. | 340/365 A |
| 3,911,780 | 10/1975 | Dyle et al. | 340/365 A X |
| 4,359,613 | 11/1982 | Rooney | 200/5 R |

*Primary Examiner*—J. R. Scott

*Attorney, Agent, or Firm*—Schmidt, Johnson, Hovey & Williams

[57] ABSTRACT

A keyboard encoding device which directly develops a digital, valid and reliable output signal without electronic encoding circuitry. The preferred device has a plurality of juxtaposed, flexible conductive strands or wires each having a number of axially spaced impact zones which are either insulated or conductive; corresponding zones on the separate wires are aligned to cooperatively define a series of spaced impact zone sets each made of a unique pattern of conductive and insulated zones. An electrically conductive, rubber-like resilient pad having a series of ridge-like elongated members respectively aligned with corresponding impact zone sets is oriented for shifting of the members into momentary contact with the associated zone sets, whereby electrical contact is made between the ridge members and the conductive impact zones of the set. This directly generates a momentary unique, digitalized output signal. The device is particularly suited for use in impact-type keyboards.

22 Claims, 13 Drawing Figures

MOMENTARY DIGITAL ENCODING DEVICE FOR KEYBOARDS

BACKGROUND OF THE INVENTION

1. Field of the Invention

The present invention is broadly concerned with a greatly improved encoding device which, in preferred forms, directly generates digitalized output signals and provides reliable, long lived operation at minimum cost. More particularly, it is concerned with such an encoding device especially adapted for use in an impact-type keyboard to produce signals that are of extremely short duration (on the order of milliseconds or even microseconds) in order to afford a considerable degree of N-key rollover protection while at the same time eliminating the need for precision manufacture or strict tolerance limits in the components of the device.

Attention is directed to U.S. Pat. No. 4,359,612, issued Nov. 16, 1982, entitled "Universal Keyboard and Method of Producing Same", and U.S. Pat. No. 4,359,613, issued Nov. 16, 1982, entitled "Molded Keyboard and Method of Fabricating Same." Both of these patents are hereby incorporated by reference into the instant application.

2. Description of the Prior Art

A wide variety of keyboards have been proposed in the past for use in connection with typewriters, computer input stations, and numerous other devices. In the present state of the art, there are basically three types of keyboards. In one variety, electronic output in the form of electrically encoded signals to a companion or remote device is employed. In another type of keyboard, mechanical output movements are used which trip or activate leverages or linkages in either totally mechanical machines (e.g., manual typewriters) or electric machines such as electric typewriters. The principal distinguishing feature between the two types of keyboards is the form of output, i.e., mechanical movement or electric signal. A third type of general keyboard construction can be thought of as a hybrid between the electronic and mechanical units. In this form, a mechanically induced movement is read electronically by one of various kinds of transducers, and the reader outputs the detected movement in the form of signals of an electronic nature.

In keeping with the diversity of keyboard designs, a number of keyboard output devices have been suggested, and such can be broadly classed as either generating mechanical output movements or electronic signals. The latter type of output device is generally characterized by complicated logic circuitry and associated structure which is capable of sensing the depression of a particular key and, in response to such sensing, generating an electronic output signal, typically in the form of a digitalized signal. Additionally, provision must be made by scanning or other techniques to prevent false signals or ambiguities by virtue of problems associated with N-key holddowns and key teasing. It will of course be appreciated that such expedients add considerably to the cost and complexity of an output device, and are therefore deficient for these reasons.

U.S. Pat. No. 3,353,038 to Mason et al. describes a keyboard wherein use is made of elongated, vibratory cantilevers mounted adjacent each key arm. A piezo-electric crystal element is mounted in contact with each vibratory cantilever in order to generate an output signal for the key. In operation, depression of a key serves, through an intermediate magnet, to draw the associated cantilever downwardly until a stop is reached; at this point the cantilever is disengaged from the magnet, and begins to vibrate, thus generating an output signal through the piezo-electric crystal. A similar construction is disclosed in U.S. Pat. No. 3,725,908 to Brisebarre et al. In this unit, an elongated cantilever is actuated upon key depression in order to impact-engage an underlying piezo-electric crystal.

Both the above mentioned constructions are incapable of directly generating a digitalized keyboard output. That is to say, each cantilever actuates one and one only piezo-electric crystal, thus necessitating logic circuitry or the like for the purpose of encoding the respective signals received from the keys as they are depressed.

U.S. Pat. No. 4,258,356 discloses a keyboard having an encoding apparatus in which strikers are actuated by the keys of a keyboard. These strikers engage one or more parallel acoustic bars, in order to generate acoustic energy which is ultimately transduced as an encoded signal. A significant problem associated with keyboards of the type described in U.S. Pat. No. 4,258,356 stems from the fact that the strikers are, at rest, in contact with the associated acoustic bars. This not only presents formidable difficulties from the standpoint of tolerances and machining requirements, in assuring proper, multiple contact points, but can also give rise to cross vibrations and false signals. That is to say, vibrations induced in one bar can be transmitted through downstream strikers in engagement with the bar and other bars so that the transducer apparatus coupled to the other bars senses a vibration when, in reality, such other bars have not actually been struck. In addition, the acoustic output system must be isolated from accidental noise from sources other than the keyboard, else false signals will be generated.

In short, there is real and heretofore unsatisfied need in the art for a keyboard output device which is rugged, compact, low cost, free of electronic encoding circuitry, and which gives directly generated, digitalized output signals.

SUMMARY OF THE INVENTION

The present invention overcomes the problems noted above and provides an output device having, in preferred forms, a plurality of elongated, electrically conductive strands each having a number of axially spaced apart impact zones along the length thereof. Certain of the zones are covered with electrically insulative material, whereas others of the zones are free of insulative material and are conductive. The strands are mounted in side-by-side relationship and in such manner that the impact zones thereof cooperatively define a number of spaced apart sets of impact zones each made up of corresponding impact zones on a plurality of the strands. In this fashion each of the impact zone sets has a characteristic, individual pattern of insulated and conductive impact zones. The overall output device further includes an elongated, electrically conductive engagement member for each impact zone set respectively. The engagement members are located adjacent their associated zone sets, with the longitudinal axes of the members being generally transverse relative to the longitudinal axes of the strands. Each of the members is further selectively shiftable toward and into momentary impact engagement with the impact zones making up associated impact zone sets. Thus, the impact members, upon shifting thereof, make momentary electrical contact with the conductive impact zones forming a part of the impact zone sets respectively associated therewith.

In particularly preferred forms, the strands are flexible and mounted in tension, and the impact zones of each set thereof are in aligned, substantially side-by-side relationship to each other. On the other hand, the conductive strand-engaging members are advantageously formed of a conductive rubber-like material and are integral with and supported by an elongated, flexible web of such material.

In order to maintain the integrity of the output device from accumulation of dirt or spills, it is desirable to encase the encoding strands and conductive members within a flexible tubular sheathing.

The output device of the invention is especially designed for use with an impact-type keyboard of the types described in the above referenced U.S. letters patent, and particularly that shown in U.S. Pat. No. 4,359,613. That is to say, such an impact-type keyboard includes a plurality of keys mounted for individual, selective depression thereof and having a resilient, shiftable element for each key respectively. Means is provided for operably coupling each key, upon depression thereof, with the associated element for initially shifting and increasing the potential energy of the element, followed by release of the element in order to allow the latter to move freely. Upon such return movement of the element, the output device of the invention is struck at the region of the associated conductive member, in order that the conductive member engages the adjacent impact zone set and creates the desired digitalized output signal. Preferably, the respective elements each have rest positions, and are designed to overfly or overtravel past their rest positions upon release thereof; impact engagement with the adjacent output device occurs during such overtravel shifting in order to assure momentary, pulse-like, one-time contact between the element and the output device.

A particularly important feature of the output device resides in the fact that the encoding strands are preferably flexible and mounted in tension, and are engageable by resilient conductive members. This yieldability in the components of the output device assures positive operation notwithstanding the possibility of tolerance errors during manufacture or slight movement of the encoding strands during or as a result of operation of the keyboard.

DESCRIPTION OF THE PREFERRED EMBODIMENT

Figure 1:
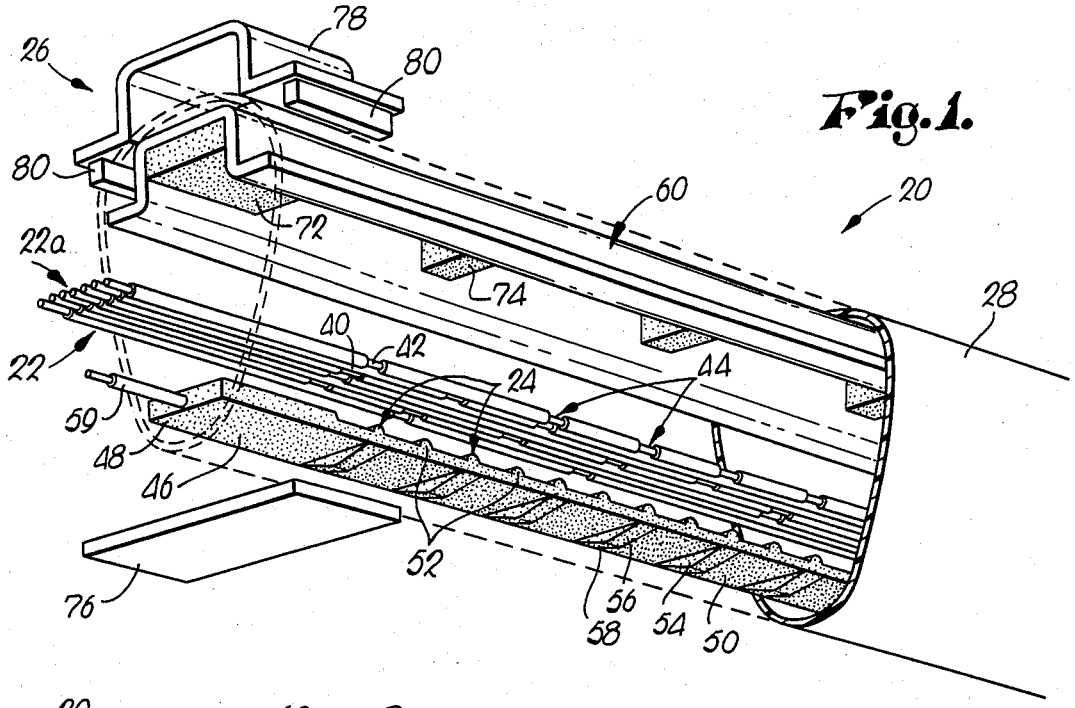
FIG. 1 is a greatly enlarged, exploded perspective view of a keyboard output device in accordance with the invention, with parts broken away for clarity.
Figure 2:
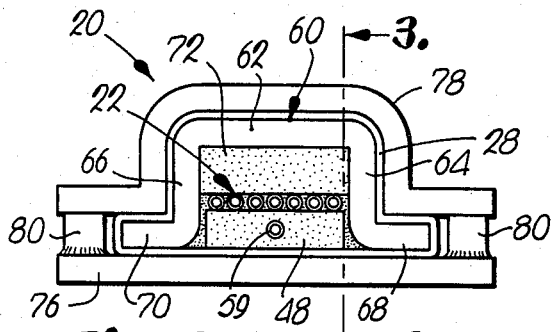
FIG. 2 is an end elevational view of the output device depicted in FIG. 1.
Figure 3:
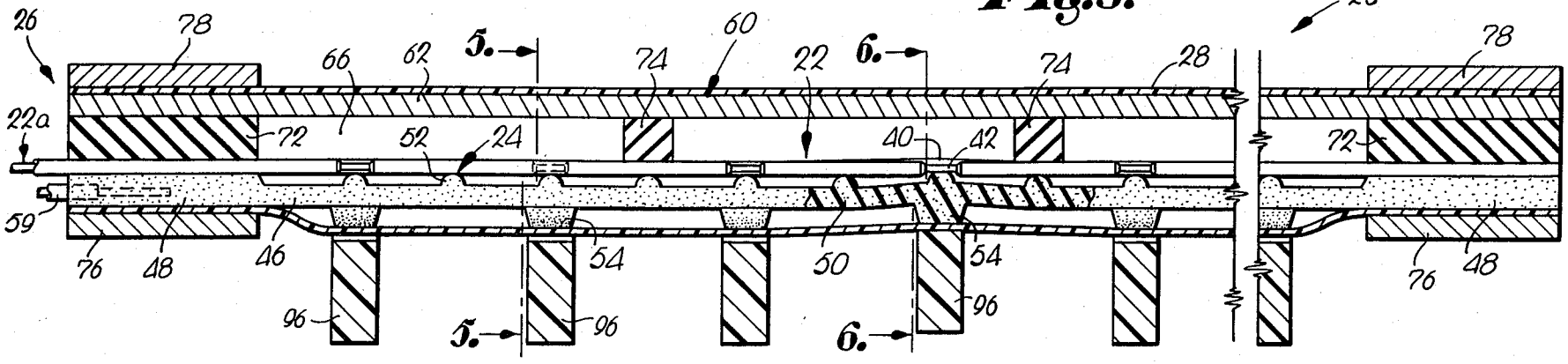
FIG. 3 is a fragmentary vertical sectional view taken along line 3—3 of FIG. 2 and illustrating the operation of the output device.

Turning now to the drawings, an encoding device 20 is illustrated in FIGS. 1–3. Broadly speaking, the device 20 includes a plurality, here seven, of electrically conductive strands 22 mounted in juxtaposed relationship with each other, a series of spaced apart, electrically conductive ridge-like strand-engaging members 24 located adjacent and below the strands 22 and oriented generally transversely relative to the longitudinal axes of the strands, support structure broadly referred to by the numeral 26 for supporting the strands 22 and members 24, and a protective bag-like casing 28 disposed about the device to protect the same from the effects of dust and dirt and the like. The device 20 is particularly adapted for use in an impact-type keyboard. One such preferred keyboard 30 is illustrated in FIGS. 7–13. The keyboard 30 includes a plurality of keys 32 arranged in respective rows, with elongated key-supporting arms 34 for supporting the keys 32 for individual, selective depression thereof. The board 30 also is provided with a series of resilient, shiftable elements 36 which are respectively associated with each key. As will be more fully described hereinafter, depression of a particular key 36 serves to shift and then release the associated element, whereupon the latter strikes the device 20 at a specific location, so that the device 20 directly develops a digitalized output signal.

In more detail, each of the strands 22 is in the form of an elongated, relatively thin, flexible electrically conductive, metallic wire (e.g., stainless steel of 0.005-inch diameter) having a number of axially spaced apart impact zones 38 along the length thereof. Certain of the zones 38 are covered with electrically insulative material as at 40, whereas other of the zones are free of insulative material as at 42 (see FIG. 4). In practice, the strands 22 are simply conductive metallic wires coated or sheathed in insulative material, and certain of the impact zones along the length thereof are stripped of insulation by any convenient means in order to present the insulative and conductive zones. The strands 22 are normally biased to an electrical output of, e.g., 5–12 volts during operation of the keyboard.

Figure 4:
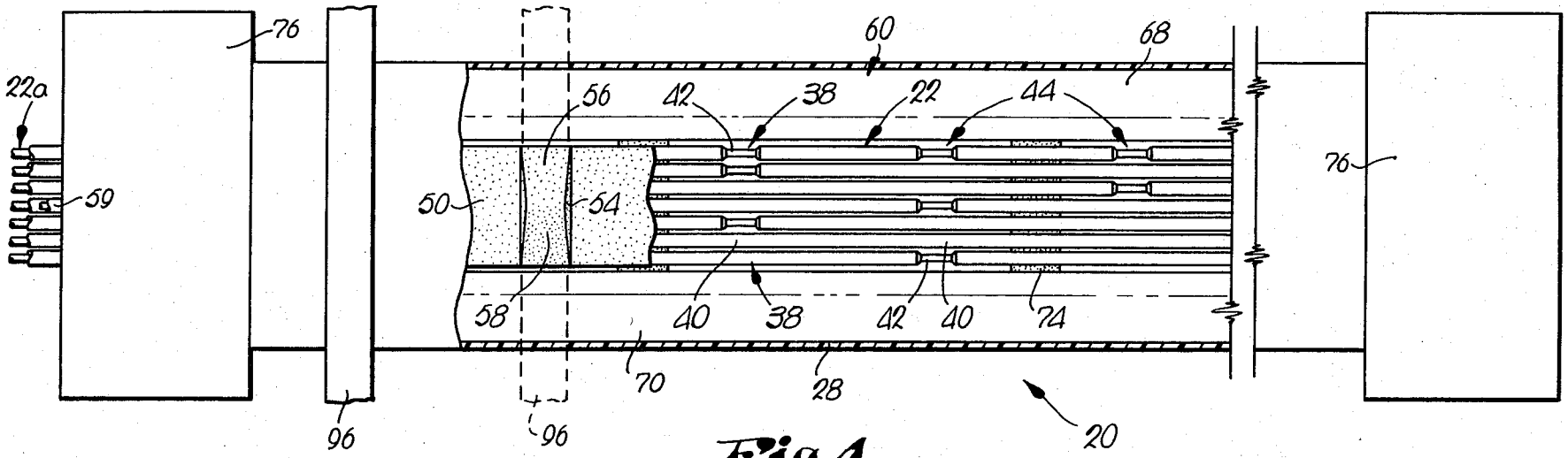
FIG. 4 is a fragmentary bottom view with parts broken away for clarity illustrating the construction of the output device.

The strands are mounted under tension in side-by-side relationship with each other and are capable of limited independent flexure. The impact zones 38 of each wire are similarly oriented in side-by-side relationship with corresponding impact zones on the other strands. In this fashion, a number of axially spaced apart impact zone sets 44 are cooperatively defined by the zones 38 on the parallel strands. Each of the sets 44 is made up of adjacent juxtaposed impact zones, one on each of the seven strands in the array. In addition, as best seen in FIG. 4, each of the impact zone sets 44 has a characteristic individual pattern of insulative and conductive impact zones. For example, and referring to FIG. 4, it will be seen that the left-hand impact zone set 44 presents, from top to bottom as viewed in FIG. 4, conductive impact zones 42 on the first, second and fifth wires, whereas insulative zones 40 are provided on wires three, four, six and seven. In contrast, the next adjacent impact zone set 44 illustrated in FIG. 4 has conductive impact zones 42 on wires one, four and seven, whereas the remaining zones of the set are insulative. It will thus be appreciated that, for each key of the keyboard, there is provided a unique combination of insulative and conductive impact zones in the zone set associated with such key. Moreover, although a seven strand array has been illustrated in the drawings, those skilled in the art will readily understand that a greater or lesser number of strands could be employed, depending upon the number of key stations to be digitally encoded.

The strand-engaging members 24 are preferably supported by and integral with an elongated, flexible, graphite-filled conductive, polymeric, rubber-like pad 46 (see FIGS. 1 and 3) having a relatively low resistance by volume. Typically, the pad is at ground potential with respect to the strands 22, so that, upon impact between a member 24 and conductive zones 40, circuit(s) are grounded to generate the appropriate output signal. The pad includes enlarged end portions 48 with a central web section 50 extending between the end portions. The elongated ridge-like members 24 extend upwardly from the upper surface of web section 50 and are substantially semicircular in cross section. The pads extend transversely across the web section 50 and are oriented in substantially perpendicular relationship relative to the longitudinal axes of the strands 22. An elongated dampening ridge 52 is situated between each pair of strand-engaging members 24, as best seen in FIG. 3. The dampening ridges 52 are essentially identical in size, shape and orientation with the adjacent members 24. The purpose of these dampening ridges 52 will be explained hereinafter.

An elongated, depending, transversely extending engagement block 54 is situated beneath and aligned with each respective member 24. Each block 54 is generally triangular in configuration (see FIG. 1) and presents a pair of inclined, converging outer surfaces 56, 58. The blocks 54 are likewise integral with the web section 50 of pad 46 and are oriented transverse to the longitudinal axis of the latter in substantially spanning relationship to the web section.

The pad 46 is provided with a conductive lead 59 for connection, along with the leads 22*a* of the strands 22, to any appropriate, conventional signal interpretation and utilization apparatus (not shown). Such apparatus is coupled to the printer mechanism in the case of a typewriter for the purpose of printing the characters corresponding to the signals developed by device 20.

The support structure 26 includes an elongated metallic channel member of inverted, generally U-shaped configuration which extends along the length of and receives the strands 22 and pad 46. In this connection it will be observed that the channel 60 includes a generally planar top wall 62, a pair of spaced apart, depending, parallel sidewalls 64, 66, and a pair of outwardly extending flange walls 68, 70 forming an extension of the sidewalls 64, 66 at the lower ends thereof. It will be appreciated that the walls 62–70 cooperatively define an elongated interior channel for receipt of the operative components of device 20, as best seen in FIGS. 1 and 2. In this regard, a relatively large resilient silicone rubber mounting pad 72 is provided at the extreme ends of the channel 60, within the elongated recess thereof (see FIGS. 1 and 3). In addition, the channel 60 is provided with a plurality of axially spaced, transversely extending resilient silicone rubber frets 74 situated within the strand-receiving recess and oriented such that the undersides of the frets serve to resiliently engage and stabilize the strands 22 during operation thereof as will be explained.

The overall support structure 26 further includes a pair of end-mounted lowermost metallic plates 76, as well as end-mounted upper brackets 78 of inverted U-shaped configuration. The brackets 78 and plates 76 are secured together as best seen in FIG. 2, in order to firmly support and stabilize the ends of the device 20. In this regard, it will be seen that the bracket 78 is configured to receive the adjacent end of the channel 60, and that the bracket 78 includes depending connection portions 80 which abut and are secured to plate 76.

Figure 5:
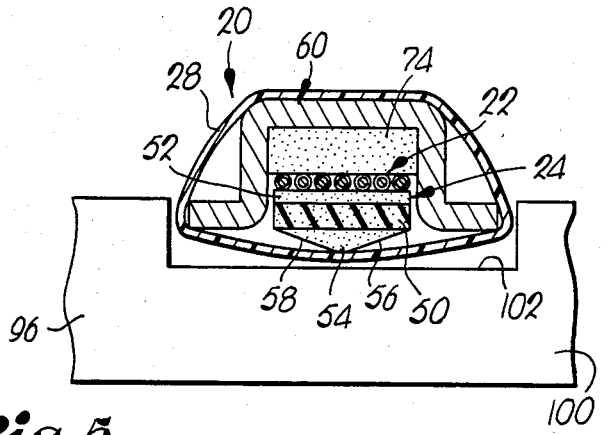
FIG. 5 is an enlarged vertical sectional view illustrating the output device operatively positioned adjacent a keyboard flipper.

The casing 28 is formed of any suitable flexible synthetic resin material and is wrapped about and engages the component 60 and the respective spaced apart engagement blocks 54 (see FIG. 5). The casing is maintained in position about device 20 by virtue of being sandwiched at the opposed ends thereof between the brackets 78 and the adjacent channel 60, and between the plates 78 and flange walls 68, 70. The casing 28 is flexible, particularly along the underside thereof adjacent the blocks 54 and members 24, in order to permit selective impact of the device 20 during operation of the keyboard.

Figure 7:
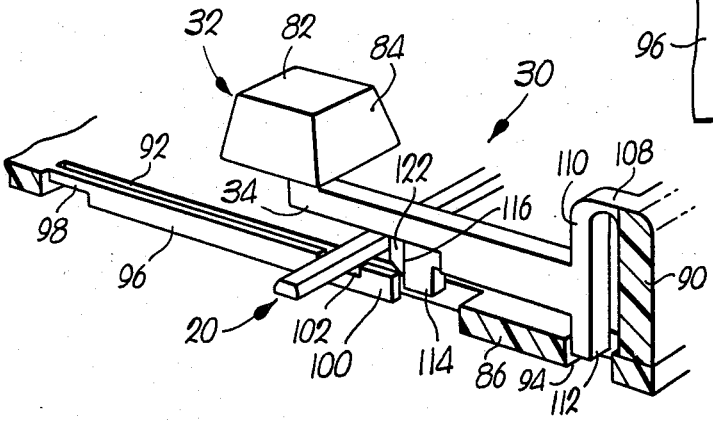
FIG. 7 is a fragmentary perspective view illustrating an impact-type keyboard arrangement with the output device of the invention operatively arranged relative thereto.

Turning now to FIGS. 7–13, the preferred keyboard arrangement for use with the encoding device 20 will be described. This keyboard is of the type described in U.S. Pat. No. 4,359,613 referred to previously. In particular, it will be seen that each of the keys 32 is preferably formed of a synthetic resin material and presents a slightly concave, uppermost finger-engagement surface 82 along with a depending, circumscribing skirt 84. The majority of the keys in a typical keyboard are essentially square in plan configuration as best seen in FIG. 7, whereas certain of the keys are oblong or L-shaped, as is conventional in many keyboards.

The keys 32 are supported by means of a substantially planar, apertured base 86 which is rectangular in plan configuration, along with a pair of spaced, opposed, upright marginal front and rear walls 88, 90 and upright, spaced, marginal sidewalls.

Figure 8:
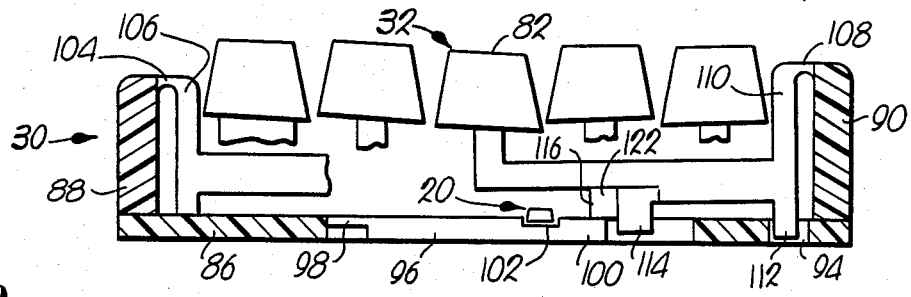
FIG. 8 is a fragmentary view in partial vertical section illustrating a multiple-key, impact-type keyboard with the encoding device of the present invention forming a part thereof.
Figure 9:
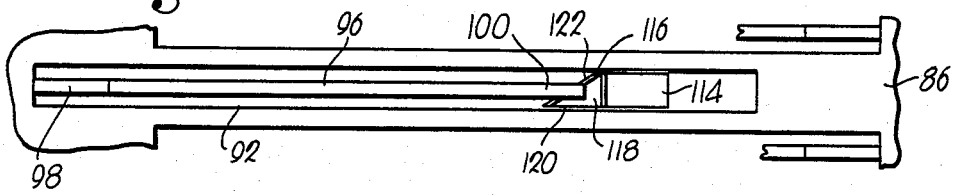
FIG. 9 is a bottom view illustrating in detail the flipper and key arm arrangement of the structure illustrated in FIG. 8.
Figure 10:
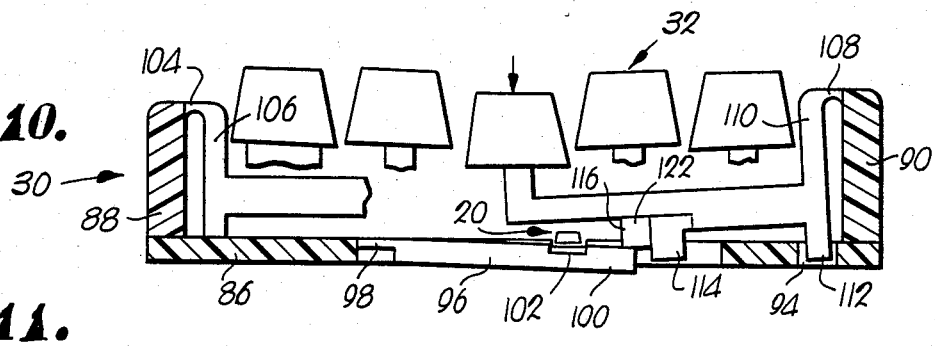
FIG. 10 is a view similar to that of FIG. 8, but illustrates the action of the keyboard during initial stages of depression of one of the keys.
Figure 11:
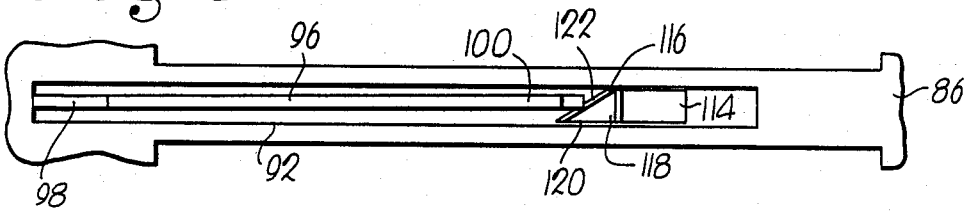
FIG. 11 is a view similar to that of FIG. 9, but depicts the orientation of the key arm and flipper during the depression shown in FIG. 10.

The base 86 is provided with a series of elongated, alternating, rectangular slots 92 therethrough which are located between the walls 88, 90; in addition, the base 86 includes, for each slot, an aperture 94 adjacent the opposed upstanding wall and in alignment with the associated slot. The elements 36 are in the form of elongated, resilient, deflectable flippers 96 respectively situated within each slot 92 and secured in a cantilever fashion therein by means of short, thin connection strips 98. The free or operating ends 100 of the flippers 96 are notched as at 102 in order to accommodate the device 20 as depicted. In effect, the notches 102 on the side-by-side flippers 96 cooperatively define an elongated channel extending between the sidewalls of the base structure, and the device 20 is situated within this channel. The key-supporting arms 34 are arranged in two sets respectively pivotally coupled to the walls 88, 90. The first set of arms coupled to the wall 88 includes alternating longer and shorter arms which are oriented in laterally spaced relationship along the length of the wall. Each of these arms extends over a portion of an associated slot 92 and flipper 96 therein. Referring to FIGS. 8–10, it will be seen that each of the arms of this set is pivotally connected to the upper margin of wall 88 by means of a thin hinge portion 104. A depending leg 106 extends from the hinge portion and has a lowermost dog thereon which is captively retained within the adjacent associated base aperture 94. The key supporting arm itself extends from the leg 106. By the same token, the set of arms coupled to the wall 90 includes intercalated longer and shorter key supporting arms with each of the arms being disposed over an associated slot and flipper. The arms of this set are supported in a manner identical with that described with respect to the first set thereof. That is to say, a hinge portion 108 and depending leg 110 serve to support each arm, with a dog 112 forming a part of the leg 110 being captively received within the associated aperture 94 (see FIG. 7).

A depending retainer 114 is secured to each of the key-supporting arms 34 and extends downwardly therefrom and is received within the associated underlying base slot 92 in order to prevent significant lateral wiggle of the arms 34 and their supported keys. Specifically, the retainer 114 fits within the open portion of the underlying slot between the extreme free end of the flipper and the end of the slot itself.

A beveled flipper-engaging member 116 is also provided with each arm 34, directly adjacent the retainer 114. The member 116 includes a generally triangular bottom wall 118 disposed partially above the end 100 of the associated flipper 96, an upright planar sidewall 120, and a beveled, substantially planar sidewall 122.

The impulse operation of keyboard 30 can best be understood from a consideration of FIGS. 7–13. In the ensuing discussion, the operation of keyboard 30 during depression of a particular key as illustrated in FIG. 7 will be described; it will be understood, however, that the operation of the remaining keys is identical in all material respects. At the outset (see FIG. 7) it will be appreciated that, in the rest position of the key, the supporting arm 34 extends generally horizontally relative to the base 86 and is pivotally movable by the associated hinge portion. In addition, the dog 112 is disposed within the underlying aperture 94 adjacent the wall 90. The orientation of the dog 112 within the aperture 90 thus limits the extent of pivotal movement of the key-supporting arm. Finally, in the rest position of the key structure, the free or operating end 100 of the underlying flipper 96 is directly beneath the bottom wall 18 of the flipper-engaging member 116.

Upon initial depression of the key (see FIGS. 8 and 9), the surface 118 on the member 116 comes into contact with end 100 of the flipper 96. Continued downward movement of the key under the influence of finger pressure (FIGS. 10 and 11) serves to deform and deflect the end 100 of the flipper 96 downwardly, with the effect that the potential energy of the resilient element is increased, along with its resistance to further deflection.

Figure 12:
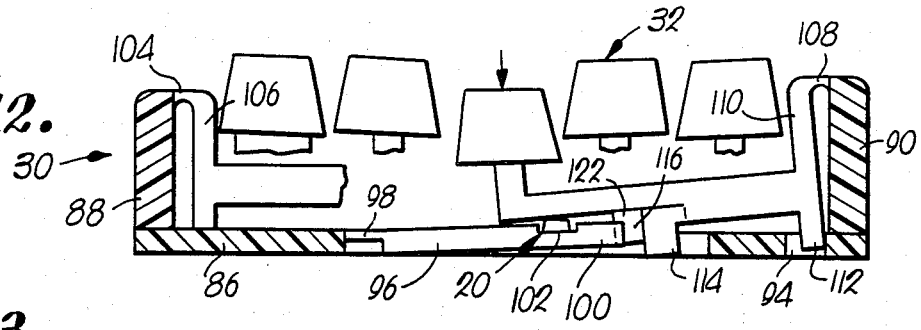
FIG. 12 is a view similar to that of FIGS. 8 and 10, but illustrates one of the keyboard flippers after release thereof and during its overtravel shifting and striking of the encoding device.
Figure 13:
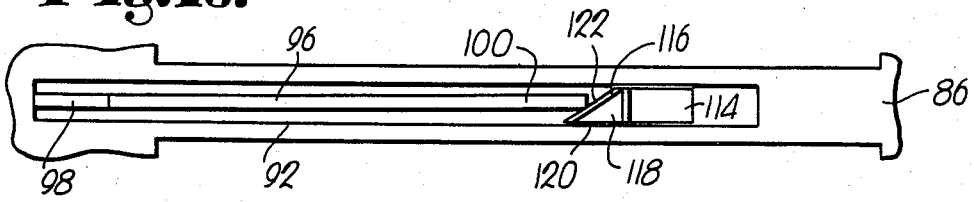
FIG. 13 is a bottom view similar to that of FIGS. 9 and 11, but illustrates the configuration of the key arm and flipper during the overtravel sequence depicted in FIG. 12.

By virtue of the pivoting action of the flipper-engaging member 116 and the surface 118 thereof, a point is reached where the surface 118 passes out of engagement with the end 100 of flipper 96. This can best be understood from a consideration of FIGS. 10–13. As such depression proceeds, it will be understood that the surface 118 pivots away from the end 100 until, as seen in FIGS. 12 and 13, the flipper 96 is completely disengaged from the surface 118. This release occurs prior to travel of the key arm 34 through its full keystroke arc.

When such disengagement occurs, the deformed and deflected flipper 96, because of the resilient nature thereof, springs back upwardly at a very high rate of speed toward its rest position. However, during such return movement of the flipper 96, the flipper overtravels the original starting or rest position thereof, and, during such overtravel, engages with a momentary impact the encoding device 20. The duration of contact between the flipper 96 and the device 20 is extremely short, owing to the rapid overtravel shifting of the flipper, and is on the order of milliseconds or even microseconds. Also, the speed of the flipper after release thereof is independent of further depression or key movement; moreover, the key cannot be actuated again until it is released and allowed to reset itself above the associated flipper.

Referring again specifically to FIGS. 1–6, the operation of the device 20 upon impacting thereof by the flippers 96 will be described. Specifically, when the impact member 96 associated with a particular key is released and allowed to overtravel its rest position, it comes into momentary contact with the underside of device 20, at the region of an associated block 54 (see FIG. 3). This in turn serves to rapidly shift the opposed strand-engaging member 24 upwardly until a momentary contact is made between this member 24 and all of the impact zones 38 of the adjacent, associated impact zone set 44. As noted above, the engaged impact zone set has a unique pattern of insulative and conductive impact zones 40, 42. Referring to the conductive zones 42 of the set 44, it will be appreciated that engagement thereof by the conductive rubber member 24 serves to complete a circuit(s) between the pad 46 and those conductive zones 42. The potential difference between the pad 46 and wires 22 (the pad 46 normally being at ground potential in the currently preferred embodiment) generates current flow through the completed circuit(s), with the effect that a directly encoded and digitalized output signal, unique for the key depressed, is generated. In effect, the respective members 24, and the associated impact zones 42 included in the adjacent impact zone set, present a group of electrical, momentary contact switches; those switches being momentarily closed during the described operational sequence to generate a current flow signal.

During the described operation of device 20, the dampening ridges come into play in order to preclude the possibility that, upon depression of a particular key and resultant shifting of the pad 46 at the region of the appropriate member 24, the adjacent region 24 will be shifted to an extent sufficient to engage its associated impact zone set and create a false signal. Specifically, the ridges 52 serve to dampen any excessive motion of the pad 46 and to localize shifting thereof at the desired region.

Figure 6:
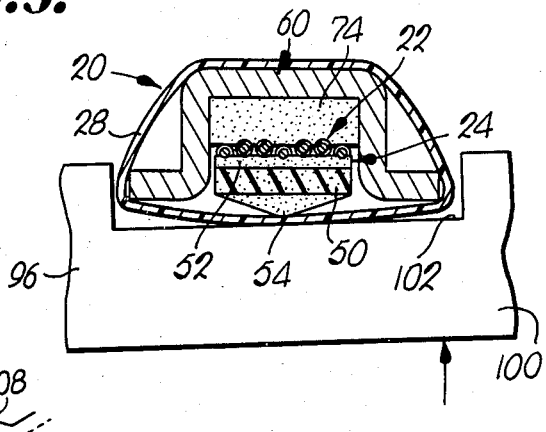
FIG. 6 is a view similar to that of FIG. 5, but illustrates engagement between the flipper and device during overtravel shifting of the flipper.

It will also be seen that the flexible nature of the strands 22, together with the resilient construction of the members 24, yields a number of significant advantages. For example, by virtue of this construction, the components of the keyboard need be manufactured using only conventional tolerance limits, inasmuch as the flexibility of the strands and/or resilience of the members 24 will "take up" any dimensional differences without affecting the operation of device 20. For example, as best seen in FIG. 6, upon upward shifting of a selected member 24 under the influence of an impact from the underlying flipper, the insulative impact zones (strands numbers two, three, five and six from left to right in FIG. 6) are deflected upwardly to a slightly greater extent than the conductive impact zones on wires one, three and seven. Thus, the dimensional differences inherent in the side-by-side conductive and insulative impact zones are not critical, in that the preferred construction has sufficient "give" to accommodate these differences without adverse operational results. Hence, in the preferred keyboard, all of the strands 22 are engaged by each member 24 upon actuation thereof, and this is accomplished without the manufacturing or operational difficulties of constructions such as those described in U.S. Pat. No. 4,258,356. Furthermore, the construction of the device 20 permits encapsulation thereof by means of the casing 28, so that dust, dirt and other pollutants are prevented from interfering with the operative mechanism of the encoding device.

In order to provide essentially constant resilient backing for the strands 22 along the length thereof, the frets 74 are employed. This establishes a more uniform resistance to movement of the strands in order that electrical characteristics (such as signal duration, rise time, constant resistance, etc.) of the resultant, encoded signals will be rendered substantially uniform. In this regard, the combination of metallic channel 60, and the pads 72 and frets 74, serve to specifically limit the extent of upward travel of the strands 22 and members 24 upon operation of the keyboard. Moreover, the electrical output signals operated by device 20, as well as the inherent flexibility of the system, makes it advantageous.

I claim:

1. A keyboard output device, comprising:

a plurality of elongated, electrically conductive strands each having a number of axially spaced apart impact zones along the length thereof, certain of said zones being covered with electrically insulative material, to thereby render them insulated, and other of said zones being free of insulative material and thereby electrically conductive;

means mounting said strands in juxtaposed relationship with each other, and with the impact zones of certain of said strands being in proximal relationship with corresponding impact zones on other of said strands, to thereby cooperatively define a number of spaced part sets of impact zones each made up of corresponding impact zones on a plurality of said strands;

each of said impact zone sets having a characteristic, individual pattern of insulated and conductive impact zones;

an elongated, electrically conductive engagement member for each impact zone set respectively;

means mounting said members adjacent their associated sets, with the longitudinal axes of the members being generally transverse relative to the longitudinal axes of said strands, each of said members being selectively shiftable toward and into momentary impact engagement with at least certain of the impact zones making up the associated impact zone set, in order that said conductive impact members, upon said shifting thereof, will make momentary electrical contact with the conductive impact zones forming a part of the impact zone sets respectively associated therewith.

2. The device as set forth in claim 1, said strands being mounted in tension.

3. The device as set forth in claim 1, said strands being sheathed in said insulative material, the insulative material being removed at the locations of said conductive impact zones.

4. The device as set forth in claim 1, said the zones of each set thereof being in substantially side-by-side relationship to each other.

5. The device as set forth in claim 1, each of said members being formed of yieldable material.

6. The device as set forth in claim 5, each of said members being formed of electrically conductive rubber-like material.

7. The device as set forth in claim 1, there being an elongated, flexible web supporting said members.

8. The device as set forth in claim 7, said web and members being integral, and formed of electrically conductive rubber-like material.

9. The device as set forth in claim 8, said web being provided with a plurality of engagement blocks on the face thereof remote from said members, said blocks being in alignment with said members.

10. The device as set forth in claim 9, said blocks being of generally triangular configuration.

11. The device as set forth in claim 1, including a plurality of strand-engaging frets located adjacent the face of said strands remote from said members.

12. The device as set forth in claim 1, including an elongated, tubular casing surrounding said strands and members, said casing being flexible at the region of said members to permit selective impact engagement and said shifting thereof.

13. The device as set forth in claim 1, each of said impact zone sets being made up of a single impact zone on each of said strands.

14. The device as set forth in claim 1, said strands being flexible.

15. The device as set forth in claim 1, each of said members being selectively shiftable toward and into momentary impact engagement with all of the impact zones making up the associated impact zone set.

16. A keyboard output device, comprising:

a plurality of elongated, flexible strands each having a number of axially spaced apart impact zones along the length thereof;

means mounting said strands in juxtaposed relationship with each other, and with the impact zones of certain of said strands being in proximal relationship with corresponding impact zones on other of said strands, to thereby cooperatively define a series of spaced apart sets of impact zones each made up of corresponding impact zones on a plurality of said strands;

an elongated, resilient engagement member for each impact zone set respectively;

means mounting said resilient members adjacent their associated sets, with the longitudinal axes of the members being generally transverse relative to the longitudinal axes of said strands, each of said members being selectively shiftable toward and into engagement with the impact zones making up the associated set, the flexibility of said strands, and the resilience of said members, serving to assure contact between the members and the impact zones of the sets associated therewith notwithstanding dimensional differences or movement of the strands during operation of the output device; and means for generating an individual keyboard output upon shifting of each of said resilient members into engagement with the impact zones making up the set associated therewith.

17. The device as set forth in claim 16, said members being formed of rubber-like material.

18. The device as set forth in claim 16, each of said strands being electrically conductive with certain of the zones therealong being covered with electrically insulative material and other of said zones being free of insulation, each of said impact zone sets having a characteristic, individual pattern of insulated and conductive impact zones, said members being electrically conductive, whereby, upon said shifting of the member, the members make electrical contact with the conductive impact zones forming a part of the impact zone sets respectively associated therewith.

19. A keyboard, comprising:

a plurality of keys;

means mounting said keys for individual, selective depression thereof;

a resilient, shiftable element for each key respectively;

means for operably coupling each key, upon said depression thereof, with the associated element for initially shifting and thereafter releasing the element to allow the element to freely move; and means for sensing the movement of said elements, and for generating keyboard output signals corresponding to the sensed movement of the keys, including:

a plurality of elongated electrically conductive strands each having a number of axially spaced apart impact zones along the length thereof, certain of said zones being covered with electrically insulative material, to thereby render them insulated, and other of said zones being free of insulative material and thereby electrically conductive;

means mounting said strands proximal to said elements, said strands being in juxtaposed relationship with each other and with the impact zones of certain of said strands being in proximal relationship with corresponding impact zones on other of said strands, to thereby cooperatively define a number of spaced apart sets of impact zones each made up of corresponding impact zones on a plurality of said strands, each of said impact zone sets having a characteristic, individual pattern of insulated and conductive impact zones;

electrically conductive structure associated with each element respectively for, upon said movement of each element, causing momentary electrical contact between the associated structure and the conductive impact zones forming a part of the corresponding impact zone set.

20. The keyboard of claim 19, said strands being flexible and mounted in tension.

21. The keyboard of claim 19, said conductive structure comprising an elongated, strand-engaging conductive member for each element, each of said members being separate from the associated element and located between the latter and the corresponding impact zone set.

22. The keyboard of claim 19, each of said elements having a rest position, and being shiftable under the influence of said coupling means away from said rest position, the elements being mounted for overtravel shifting past said rest positions after said release thereof, said movement sensing and signal generating means being operable as a result of and in response to such overtravel shifting.

* * * * *